US005503288A

United States Patent [19]

Conconi

[11] Patent Number: 5,503,288

[45] Date of Patent: Apr. 2, 1996

[54] CONTAINER FOR SMALL OBJECTS, WITH MUTUAL COUPLING MEANS

[76] Inventor: Luigi Conconi, Via Ravizza 40, 20149 Milan, Italy

[21] Appl. No.: 331,840

[22] Filed: Oct. 31, 1994

[30] Foreign Application Priority Data

Nov. 16, 1993 [IT] Italy ..... MI93O0888

[51] Int. Cl.[6] ..... B65D 21/00

[52] U.S. Cl. ..... 220/4.21; 220/23.4

[58] Field of Search ..... 220/4.21, 23.4

[56] References Cited

U.S. PATENT DOCUMENTS

| | | | |
|---|---|---|---|
| 3,194,426 | 7/1965 | Brown, Jr. | 220/23.4 |
| 3,374,917 | 3/1968 | Troy | 220/23.4 |
| 3,420,367 | 1/1969 | Carmichael | 220/23.4 X |
| 4,106,657 | 8/1978 | Dogliotti | 220/23.4 |

FOREIGN PATENT DOCUMENTS

| | | |
|---|---|---|
| 2537096 | 6/1984 | France . |
| 2595667 | 9/1987 | France . |
| 2093436 | 9/1982 | United Kingdom . |

*Primary Examiner*—Steven M. Pollard
*Attorney, Agent, or Firm*—Guido Modiano; Albert Josif

[57] ABSTRACT

A container for small objects, with mutual coupling elements, comprising a first and a second half-shells which can be mutually coupled to form a container for removably accommodating small objects. Furthermore, on at least one of the half-shells, engagement elements are provided for coupling with engagement elements formed on the half-shell of an adjacent container.

1 Claim, 2 Drawing Sheets

CONTAINER FOR SMALL OBJECTS, WITH MUTUAL COUPLING MEANS

BACKGROUND OF THE INVENTION

The present invention relates to a container for small objects, with mutual coupling means.

It is known that containers for small objects, generally but not necessarily games and the like, are placed inside many products.

These containers are usually constituted by two half-shells which mutually couple and substantially have a cylindrical shape with a rounded bottom.

Said container, normally made of plastics, has a very limited usefulness, since it merely contains the small objects when the container is placed inside the product to be sold but cannot be subsequently reused, as it cannot assume a specific function of its own; accordingly, said container is usually thrown away.

SUMMARY OF THE INVENTION

A principal aim of the invention is indeed to solve the above described problem, providing a container for small objects that can have a specific function of its own, so that in addition to containing small objects, as occurs with conventional containers, it can be used as an element for a snap-together game or the like.

Within the scope of this aim, a particular object of the invention is to provide a container which despite having an additional function can be used and handled with the devices that are currently in use.

Another object of the present invention is to provide a container that can be used as an integral element of more complicated structures obtained by applying further completion elements to the outer surface of the container.

Another object of the present invention is to provide a container that can be easily obtained starting from commonly commercially available elements and materials and is furthermore competitive from a merely economical point of view.

This aim, these objects, and others which will become apparent hereinafter are achieved by a container for small objects, according to the invention, which comprises a first and a second half-shells which can be mutually coupled to form a container for removably accommodating small objects, characterized in that it comprises, on at least one of said half-shells, engagement means for the coupling of engagement means formed on the half-shell of an adjacent container.

BRIEF DESCRIPTION OF THE DRAWINGS

Further characteristics and advantages will become apparent from the following detailed description of a container for small objects, illustrated only by way of non-limitative example in the accompanying drawings, wherein.

DESCRIPTION OF THE PREFERRED EMBODIMENTS

Figure 1:
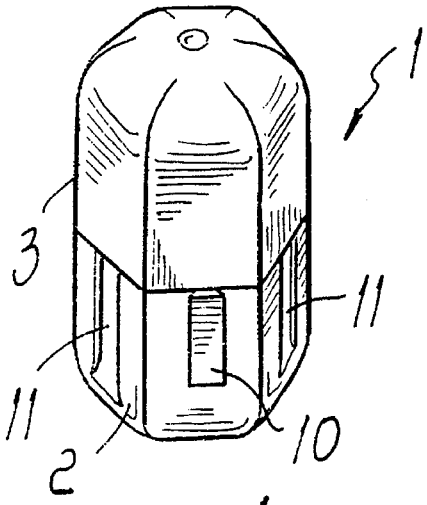
FIG. 1 is a schematic perspective view of the container according to the invention.
Figure 3:
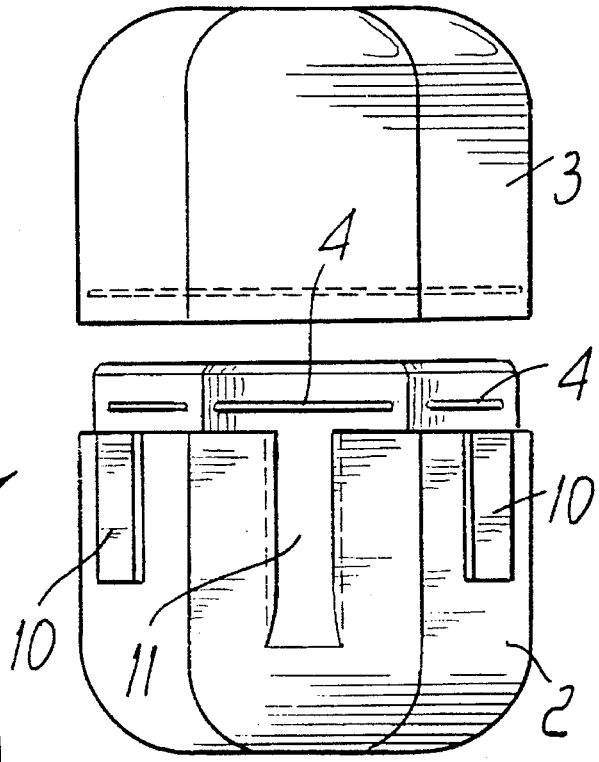
FIG. 3 is a front elevation view of the container with the two half-shells separated from one another.
Figure 2:
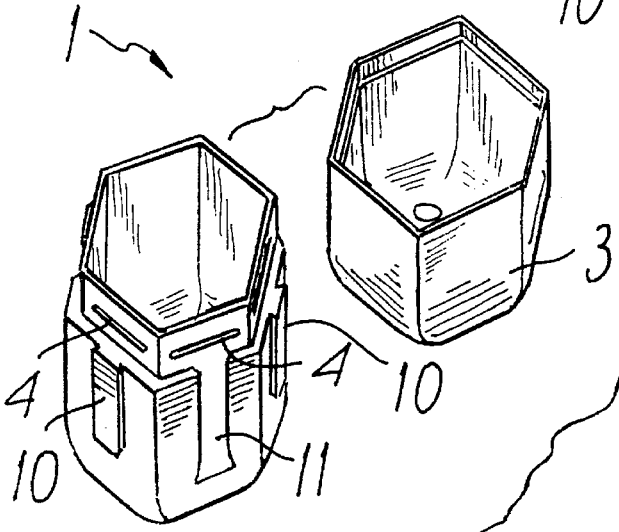
FIG. 2 is a perspective view of the container with the two half-shells in open position.
Figure 4:
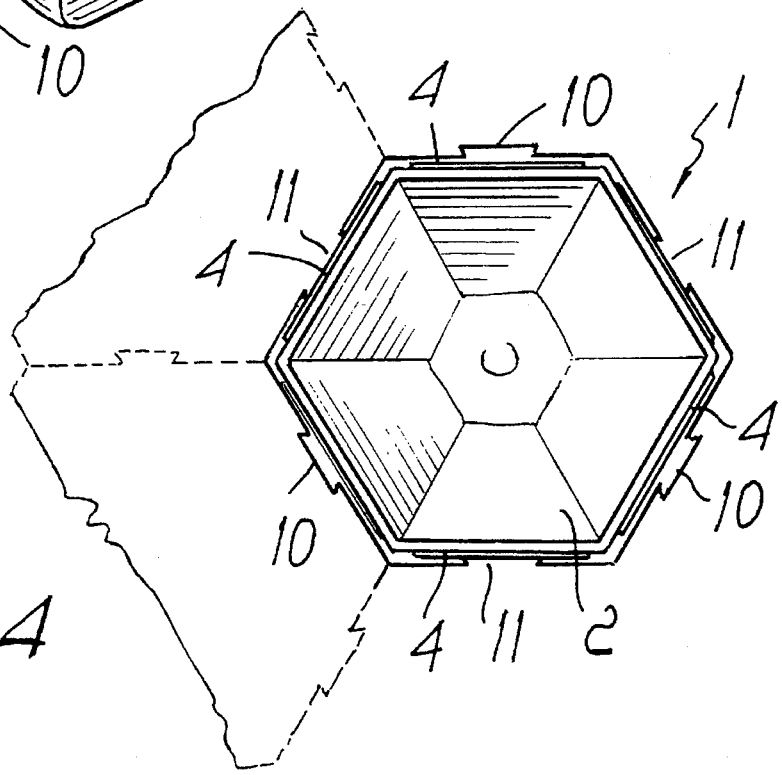
FIG. 4 is a top plan view of the container.
Figure 5:
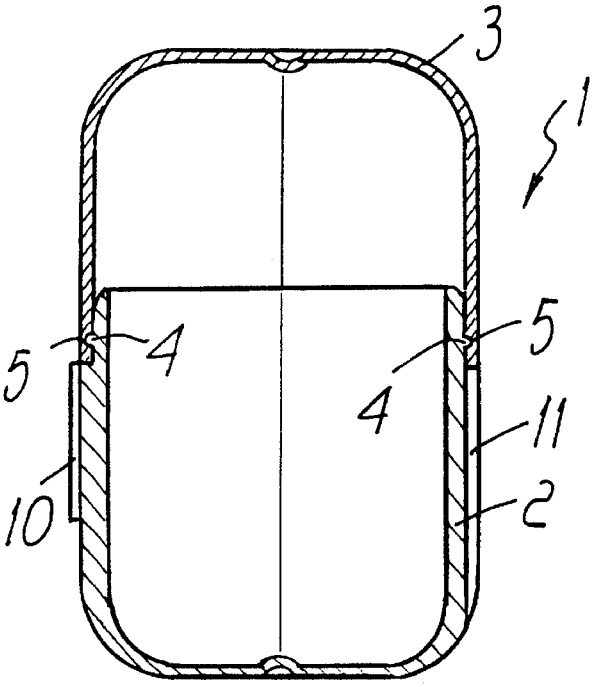
FIG. 5 is a sectional view of the container, taken along a vertical plane.
Figure 6:
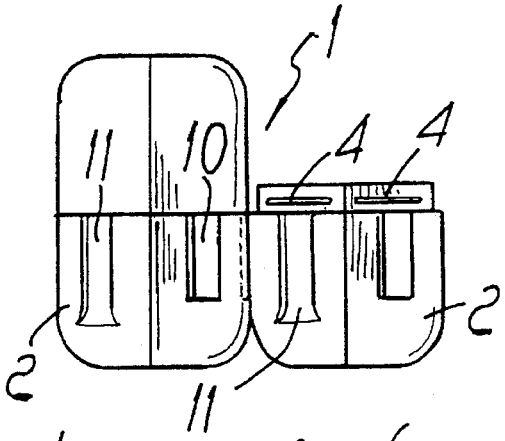
FIG. 6 is a view of a possible coupling of a container to a half-shell.
Figure 7:
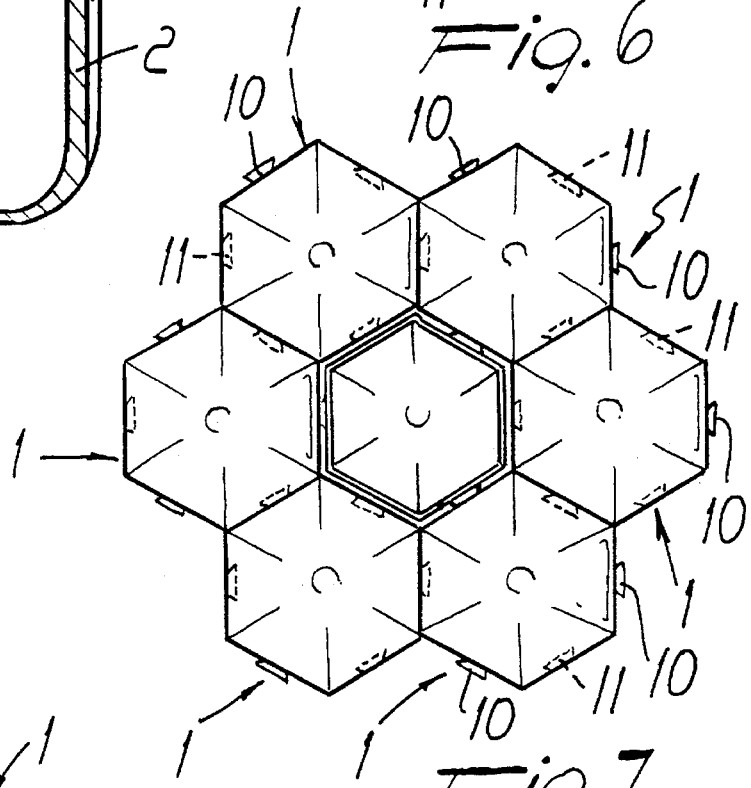
FIGS. 7 and 8 are views of two of the possible combinations obtainable by coupling the various containers.
Figure 8:
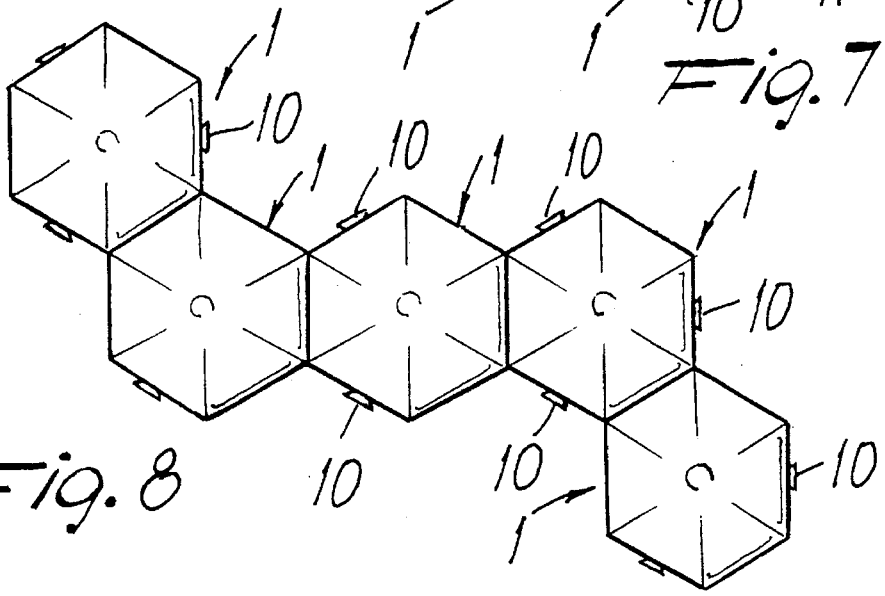

With reference to the above figures, the container for small objects according to the invention, generally designated by the reference numeral 1, comprises a first half-shell 2 and a second half-shell 3 which can be mutually coupled substantially at a median line of the vertical extension of the container by virtue of the presence of a protruding lip 4 which is formed on the first half-shell and couples in a snap-together manner in a corresponding groove 5 formed on the second half-shell.

The container has, in a transverse cross-section, a polygonal shape with an even number of sides and preferably has a shape that allows to cover the plane geometrically, such as a square, rectangle, hexagon, and so forth.

The important particularity of the invention resides in the fact that engagement means are provided on at least one of the half-shells, for example on the half-shell 2 with reference to the drawing; said engagement means are constituted by male and female elements which alternate along the peripheral region and allow to mutually couple adjacent containers having the same engagement means.

More specifically, the container according to the invention has a dovetail protrusion 10 which can be inserted in a dovetail seat 11 simply by placing the parts adjacent to each other and moving them with respect to one another along a direction that is substantially parallel to the vertical axis of the container.

As mentioned above, male engagements and female engagements are provided alternately on the outer faces of the container so that the most complete range of couplings between adjacent containers is possible.

The containers can be mutually coupled by using only the half-shells which have the engagement means as well as by closing the containers beforehand by means of the coupling of the two matching half-shells and then performing the coupling action.

It is evident that the shapes that can be obtained are practically unlimited, without altering the principle that the container 1, inside which the small objects that normally constitute the surprise or game normally placed inside food products are placed, assumes an additional function besides the direct one of containing the small objects, since said containers form the modular elements of a snap-together game.

Furthermore, the presence of the engagement means on the outer surface of the container allows to use the container as a component of more complex structures which are completed by applying, by virtue of said engagement means, completion elements which can be contained for example in the container so that the user can obtain particular structures with characteristic shapes in which the container becomes a component.

From the above description it is thus evident that the invention achieves the intended aim and objects, and in particular the fact is stressed that the presence of engagement means constituted by male engagement elements and by female engagement elements alternated on the same container allows the widest range of possible couplings.

In practice, although the best results have been obtained by using food-compatible plastics, the materials employed, as well as the contingent shapes and dimensions, may be any according to the requirements.

What is claimed is:

1. Container for small objects, with mutual coupling means, comprising a first and a second half-shells which can be mutually coupled to form a container for removably accommodating small objects, said container comprising male engagement means, arranged at upper part of said container, which engages into complementary female engagement means, which do not extend throughout the wall of said container, and which are arranged at the lower part of said container, so as to connect at least two of said containers in series arrangement; and lateral male dovetail attachment means, arranged at the side of said container, which engages into complementary dovetail attachment means, arranged at the side of said container, so as to slidably connect at least two of said containers, in parallel arrangement, wherein the cross-section of said container is substantially hexagonal.

* * * * *

UNITED STATES PATENT AND TRADEMARK OFFICE

CERTIFICATE OF CORRECTION

PATENT NO. : 5,503,288

DATED : Apr. 2, 1996

INVENTOR(S) : Luigi Conconi

It is certified that error appears in the above-indentified patent and that said Letters Patent is hereby corrected as shown below:

On cover page, item [30], change "MI9300888" into —MI93U000888—.

Signed and Sealed this

Twenty-fifth Day of June, 1996

*Attest:*

Bruce Lehman

BRUCE LEHMAN

*Attesting Officer*

*Commissioner of Patents and Trademarks*